United States Patent [19]

Heitmann et al.

[11] 4,236,534

[45] Dec. 2, 1980

[54] METHOD AND APPARATUS FOR MONITORING THE HEIGHT OF A STREAM OF TOBACCO OR THE LIKE

[75] Inventors: Uwe Heitmann, Schwarzenbek; Wolfgang Steiniger, Börnsen; Uwe Holznagel, Glinde; Hartmut Kaebernick; Joachim Pfannmüller, both of Hamburg; Joachim Reuland, Neu Börnsen, all of Fed. Rep. of Germany

[73] Assignee: Hauni-Werke Körber & Co. KG, Hamburg, Fed. Rep. of Germany

[21] Appl. No.: 933,789

[22] Filed: Aug. 15, 1978

Related U.S. Application Data

[63] Continuation-in-part of Ser. No. 821,179, Aug. 2, 1977, Pat. No. 4,190,061.

[51] Int. Cl.[3] ..... A24C 5/14; A24C 5/39

[52] U.S. Cl. ..... 131/21 B; 131/21 D; 131/84 C; 250/560

[58] Field of Search ..... 131/84, 84 C, 21 R, 131/21 B, 21 D; 250/560, 561, 578; 340/675, 676

[56] References Cited

U.S. PATENT DOCUMENTS

| | | | |
|---|---|---|---|
| 3,513,321 | 8/1967 | Sherman | 250/560 |
| 4,021,119 | 5/1977 | Stauffer | 250/561 X |
| 4,037,608 | 7/1977 | Wahle | 131/21 B |

FOREIGN PATENT DOCUMENTS

| | | | |
|---|---|---|---|
| 1468169 | 3/1977 | United Kingdom | 131/21 B |

*Primary Examiner*—Stephen C. Pellegrino
*Attorney, Agent, or Firm*—Peter K. Kontler

[57] ABSTRACT

The height of a continuous tobacco stream between a first side which is supported by a conveyor and an uneven second side is monitored by an opto-electrical level detector which directs a row of parallel light rays transversely across the stream and has a battery of photosensitive elements at different distances from the first side of the stream so that each element produces a signal in response to impingement of a different light ray upon its photosensitive surface. The number of elements which generate signals is indicative of the height of the stream portion advancing past the level detector. Such signals can be utilized to adjust a trimming device which removes the surplus at the second side of the stream before the thus equalized stream enters a wrapping mechanism to be converted into a cigarette rod which is thereupon severed to yield discrete cigarettes.

5 Claims, 2 Drawing Figures

METHOD AND APPARATUS FOR MONITORING THE HEIGHT OF A STREAM OF TOBACCO OR THE LIKE

CROSS-REFERENCE TO RELATED APPLICATION

This is a continuation-in-part of our copending application Ser. No. 821,179 filed Aug. 2, 1977, now U.S. Pat. No. 4,190,061, for METHOD AND APPARATUS FOR PRODUCING A ROD-LIKE TOBACCO FILLER.

BACKGROUND OF THE INVENTION

The present invention relates to a method and apparatus for measuring the height of a stream consisting of tobacco or the like. More particularly, the invention relates to a method and apparatus for ascertaining the height of a relatively narrow stream consisting of particulate fibrous material. Still more particularly, the invention relates to a method and apparatus for monitoring one transverse dimension of a continuously moving stream of discrete particles, e.g., a stream of tobacco shreds which contains a surplus of tobacco and is about to be trimmed prior to draping into a web of cigarette paper or the like. The resulting rod, wherein a rod-like filler of fibrous material is confined in a tubular wrapper, is thereupon severed to yield a succession of discrete rod-shaped sections, e.g., plain cigarettes of unit length.

The term "fibrous material" is intended to embrace shreds or other fragments of natural or reconstituted tobacco, shreds or other fragments of tobacco substitutes, mixtures of natural, reconstituted and/or substitute tobacco as well as filter material for use in filter mouthpieces or filter plugs for cigarettes or the like. For the sake of simplicity, the invention will be described with reference to the manufacture of plain cigarettes; however, it will be understood that the invention can be practiced also in connection with the making of filter cigarettes, plain or filter tipped cigars or cigarillos, and filter plugs.

The manufacturers of cigarettes strive to obtain a rod-like tobacco filler of uniform density (hardness), i.e., it is desirable to insure that the so-called filling force of the fillers of each of a long series of cigarettes will match or closely approach an optimum value. So-called "densely packed" cigarettes are preferred by a large majority of smokers. As a rule, the distributor of a cigarette making machine delivers particles of tobacco to the stream forming zone at a rate exceeding the requirements of the filler, i.e., the tobacco stream contains a surplus of tobacco and such surplus is removed during conversion of the stream into an equalized stream which, in turn, is compacted and thereby converted into a rod-like filler. One side of the stream which is transported past the trimming or equalizing device is exposed, and such exposed side exhibits more or less pronounced hills and valleys. The minimum height of the tobacco stream in the deepmost region of the deepest valley must still exceed (or cannot be less than) the desired height of the equalized stream. The development of hills and valleys at the exposed side of the stream cannot be avoided for a number of reasons, especially owing to the nature of tobacco. Thus, the shreds include short and long particles some of which are straight and some of which exhibit a pronounced crimp. Moreover, the particles are likely to be interlaced with each other to form clumps regardless of the fact that a modern distributor which feeds tobacco particles to the stream building zone of a cigarette maker embodies several devices whose function is to prevent the agglomeration of particles or to break up such accumulations ahead of the stream building zone.

The trimming or equalizing device is adjustable so that its knife or knives can remove larger or smaller quantities of tobacco at the exposed side or surface of the stream. Since the trimming invariably entails the formation of less satisfactory short tobacco and tobacco dust, it is desirable to form a tobacco stream which requires a minimum of trimming. Attempts to reduce the surplus in the untrimmed tobacco stream include the provision of means for preventing the formation of pronounced hills and valleys at the exposed side of the stream and/or for shifting the material from the hills into the valleys. As a rule, the removed surplus is returned into the magazine of the distributor where it increases the percentage of less desirable short tobacco.

It is already known to regulate the feed of tobacco to the stream building zone and the operation of the trimming device in dependency on a variety of parameters including the filling force of the filler in a continuous cigarette rod, the density of tobacco in the wrapped filler, the diameter of the filler and/or the corresponding characteristics of the stream ahead of the wrapping station. A drawback of such proposals is that they fail to take into consideration the geometric shape of the stream ahead of the trimming device, especially the configuration of the exposed surface of the stream, i.e., the configuration of that surface from which the knife or knives of the trimming device remove the surplus. In other words, presently known apparatus are not designed to influence the formation of an equalized tobacco stream in dependency on that parameter (i.e., the configuration of the exposed surface of the untrimmed stream) which controls the amount of removed surplus and thereby determines the quantity of short tobacco which is the byproduct of the trimming operation. As mentioned above, the development of hills and valleys is attributable to a host of factors including fluctuations in the rate of delivery of tobacco to the stream forming zone, the design of the stream forming zone, the configuration and size of tobacco particles, the nature of tobacco, the manner in which the particles of tobacco were conditioned prior to admission into the magazine of the distributor, the construction of the distributor, the nature of tobacco fibers, the magnitude of the force (suction) which attracts tobacco particles to the conveyor in the stream building zone and/or others.

British Pat. No. 1,468,,169 discloses a mechanical sensor which rides on the uneven exposed surface of a moving tobacco stream. The sensor compacts the stream and initiate the generation of signals indirectly denoting the height of successive increments of the untrimmed stream, i.e., the distance between the exposed side and the conveyor or conveyor portion supporting and advancing that side of the stream which is located opposite the uneven exposed side. The purpose of the sensor is to allow for calculation of the resistance which the stream offers to deformation, and the thus obtained signals are utilized to effect adjustments of the trimming device.

OBJECTS AND SUMMARY OF THE INVENTION

An object of the invention is to provide a novel and improved method of rapidly and accurately determining the height of a moving stream of tobacco or the like without resorting to mechanical scanning of the uneven side or surface of the stream.

Another object of the invention is to provide a method which can be practiced without adversely influencing the formation, transport and/or trimming of the stream.

A further object of the invention is to provide a method which can be resorted to for accurate measurement of the height of a moving stream of discrete fibrous particles irrespective of the speed of the stream and regardless of whether the speed is constant or fluctuates within a wide or narrow range.

An additional object of the invention is to provide a novel and improved apparatus for the practice of the above outlined method.

Another object of the invention is to provide an apparatus which can be installed in existing cigarette makers or the like.

One feature of the invention resides in the provision of a method of measuring the height of a stream, especially a relatively narrow stream, which consists of comminuted tobacco particles or the like, which has a first side and an uneven second side opposite the first side, which contains a surplus of particles, and from which the surplus is about to be removed prior to draping of the thus obtained equalized stream or filler into a web of wrapping material and subdivision of the resulting wrapped filler into discrete rod-shaped sections (e.g., plain cigarettes). The method comprises the steps of moving the stream lengthwise and optically scanning the distance between the first and second sides of successive increments of the moving stream. The step of optically scanning includes direct monitoring of the height of successive increments of the stream, as considered in the direction from the first toward the second side of the stream, i.e., at right angles to the direction of lengthwise movement of the stream.

The scanning step preferably comprises directing at least one light beam (e.g., a thin but wide light beam) transversely of the direction of movement of the stream and monitoring the extent to which the light beam is intercepted by successive increments of the stream. Such directing step may comprise directing a row of parallel light rays transversely across the path of movement of the stream at different distances from the first side of the moving stream. The monitoring step then comprises ascertaining the number of light rays which are not intercepted by the stream or ascertaining the number of light rays which are intercepted by the stream.

The method preferably further comprises the step of generating signals which denote those percentages of the light beam which are intercepted or those percentages of the light beam which are not intercepted by successive increments of the stream.

Still further, the method may comprise the step of removing the surplus from the second side of the stream at a rate which is a function of deviations of just mentioned signals from a reference signal denoting a predetermined or optimum height of the stream.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
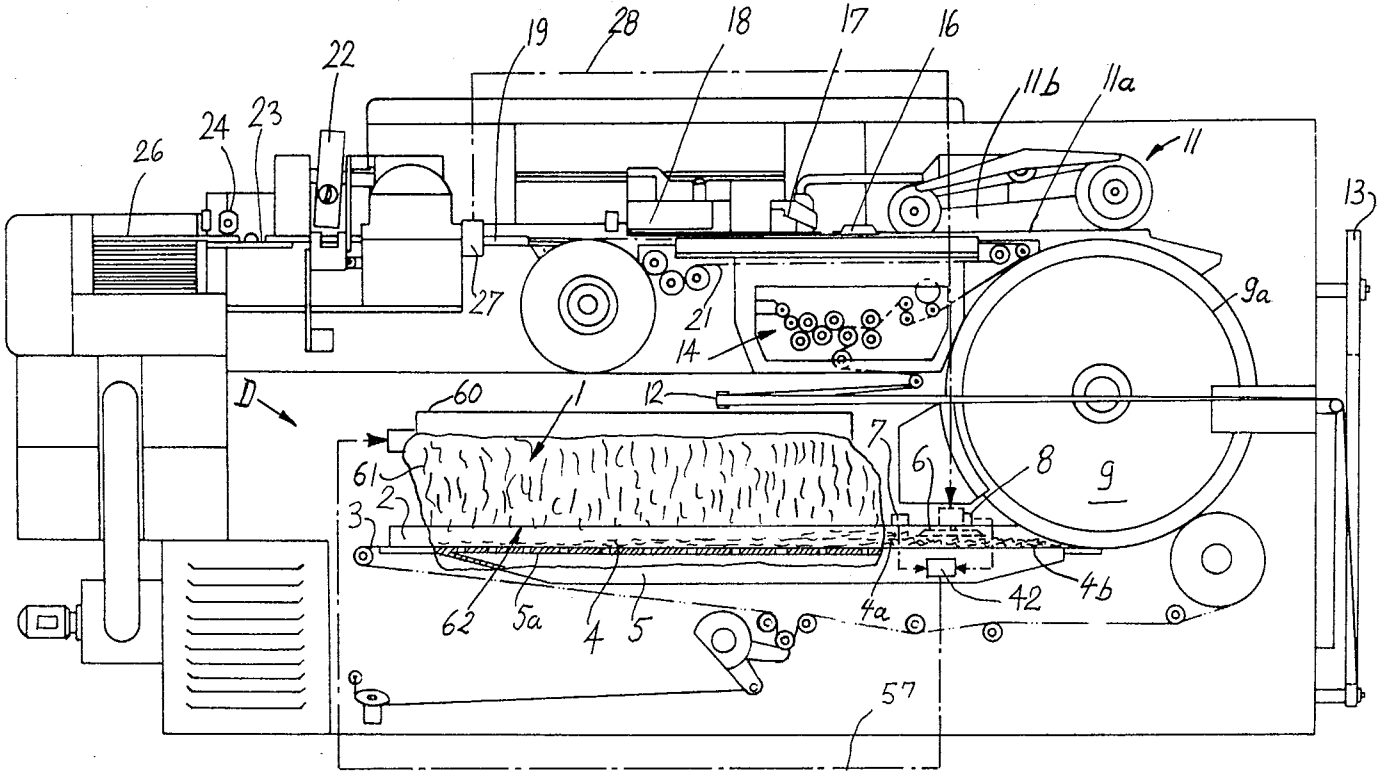
FIG. 1 is a schematic partly elevational and partly sectional view of a cigarette making machine which embodies the improved apparatus.

FIG. 1 shows a cigarette making machine of the type known as GARANT (trademark) manufactured by Hauni-Werk Körber & Co. KG., of Hamburg, Federal Republic Germany. The machine of FIG. 1 includes a distributor D having an endless band 60 which transports particles 61 of tobacco along an elongated path extending at right angles to the plane of FIG. 1. The particles 61 form a wide layer or carpet 1 and the leader of this carpet is showered into a stream building or growing zone or station 62 where the carpet 1 is converted into a continuous narrow tobacco stream **4*a* which contains tobacco in excess of that required in the filler. The wedge-like growing tobacco stream at the station 62 is shown at 4. The band 60 can transport the particles 61** at a variable rate.

The means for converting the layer 1 into the tobacco stream **4*a* comprises an elongated narrow channel 2 whose upper side is open so that the particles 61 can descend onto the upper portion or reach of a stream conveying means here shown as a narrow endless belt 3. The upper portion or reach of the belt 3 travels above the perforated top wall 5*a* of a stationary suction chamber 5 which attracts the growing stream 4 to the belt 3 and causes such stream to travel in a direction to the right, as viewed in FIG. 1. The fully grown stream 4*a* continues to move with the upper reach of the belt 3 and passes through a surplus removing station where a suitable trimming or equalizing device 6 removes the surplus or excess of particles 61 so that the remainder 4*b* of the stream 4*a* (i.e., the trimmed or equalized stream) contains only such quantities of particles 61 as are necessary to form a satisfactory rod-like tobacco filler. The trimming device 6 is shiftable up and down, as viewed in the drawing (i.e., toward and away from the upper reach of the belt 3) by a motor 106** which is actuated in response to changes in density of the tobacco filler.

The equalized stream **4*b* is fed into the circumferential groove 9*a* of a rotary suction wheel 9 which transports the stream 4*b* along an arc of approximately 180 degrees to a level above the belt 3. Successive increments of the stream 4*b* at the apex of the suction wheel 9 are caused to adhere to the underside of the lower reach of an endless foraminous belt 11*a* forming part of a transfer conveyor 11. The lower reach of the belt 11*a* travels below the at least partially open underside of a suction chamber 11*b* and serves to transfer the stream 4*b* onto a continuous web 12 of cigarette paper or other suitable flexible wrapping material. The web 12 is withdrawn from a reel 13 and is caused to pass through a conventional imprinting mechanism 14 on its way toward the upper reach of a garniture 21 forming part of a wrapping mechanism 16 wherein the stream 4b is compacted and thereby converted into a continuous rod-like filler which is wrapped into the web 12 to form therewith a continuous cigarette rod 19. The mechanism 16 further comprises a paster 17 which applies a film of adhesive to one marginal portion of the web 12. Such marginal portion is thereupon folded over the other marginal portion to form therewith a seam which is parallel to the axis of the cigarette rod 19. The seam is stabilized by a sealer 18 which heats the seam if the adhesive is a wet adhesive and cools the seam if the adhesive is a hot melt. It will be noted that, for all practical purposes, the equalized stream 4b is a rod-like filler; the mechanism 16 merely converts the stream 4b** (whose cross-sectional area resembles a polygon) into a substantially rod-like filler.

The cigarette rod 19 is severed by a cutoff 22 so that it yields a file of coaxial plain cigarettes 23. Successive cigarettes 23 are accelerated by a rotary cam 24 which propels them into the flutes of a rotary drum-shaped row forming conveyor 26. The latter delivers one or more rows of cigarettes 23 to a filter tipping machine, to storage or to a packing machine. The purpose of the cam 24 is to separate successive cigarettes 23 from each other and to propel them into the flutes of the conveyor 26 while the latter rotates, preferably at a relatively high speed.

The density of the filler which forms part of the rod 19 is monitored by a detector 27 (preferably a beta ray detector or another device including a source of corpuscular radiation) which transmits signals to the shifting motor 106 via conductor means 28. The motor 106 moves the trimming device 6 nearer to the belt 3 when the density of the filler increases, and vice versa.

Figure 2:
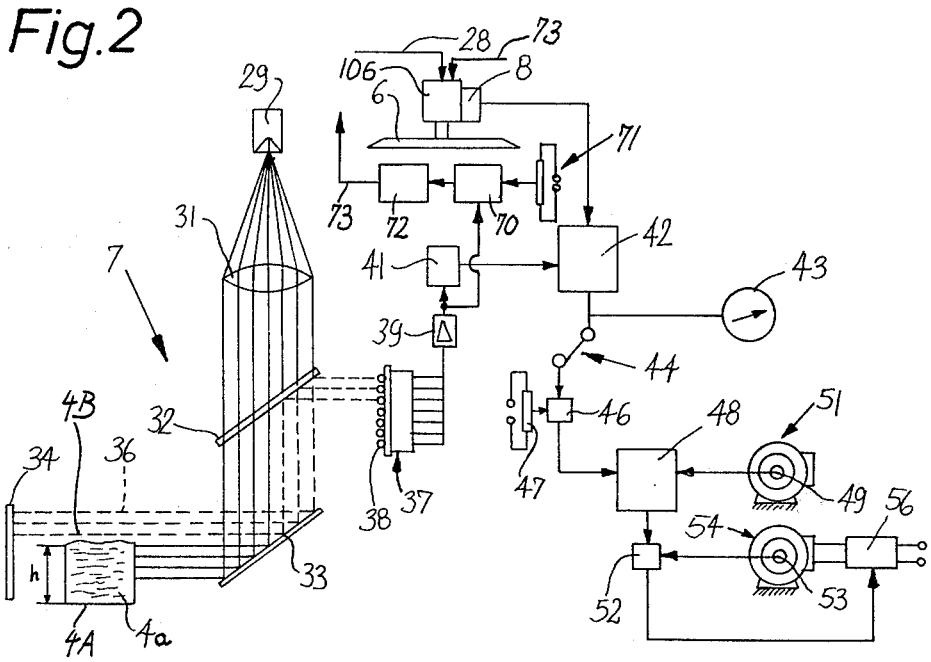
FIG. 2 is a circuit diagram of certain parts of the improved apparatus.

The improved apparatus comprises an opto-electrical level detector 7 which monitors the height of the stream 4a upstream of the trimming device 6 (i.e., prior to removal of the surplus) and a detector 8 which monitors the height of the equalized stream 4b. The detector 7 comprises a light source 29, an optical system 31 which detects a beam of (parallel) rays issuing from the source 29 against a partly light transmitting mirror 32, a fully reflecting mirror 33 which is located in the path of light rays passing through the mirror 32, and a mirror 34 which reflects light rays coming from the mirror 33. The stream 4a is caused to advance in the space between the mirrors 33 and 34 at right angles to the plane of FIG. 2; this stream absorbs some light rays and allows the remaining light rays (indicated by broken lines, as at 36) to reach the mirror 34. The latter reflects the rays 36 toward the mirror 33 which, in turn, reflects the once-reflected rays 36 against the underside of the mirror 32. The mirror 32 reflects the rays 36 against the corresponding elements of a battery or row of light-sensitive signal generating elements here shown as photoelectric cells 38 forming part of a transducer 37 which serves as a means for transmitting first electric signals to an amplifier 39 connected to the input of a summing circuit 41. In the embodiment of FIG. 2, the level detector 7 comprises seven cells 38. The intensity and/or another characteristic of first signals which are transmitted to the amplifier 39 is a function of the height of successive increments of the tobacco stream 4a. The purpose of the circuit 41 is to totalize the signals furnished by cells 38 which receive light rays 36 so that the intensity of signals at its output denotes the height h of the corresponding increments of the stream 4a. The intensity of signals at the output of the circuit 41 respectively increases and decreases proportionally with decreasing and increasing height of the stream 4a. The circuit 41 transmits first signals to the corresponding input of a dividing circuit 42, e.g., a circuit of the type sold by Analog Devices under the designation AD 530. The height h of successive increments of the stream 4a is measured in a direction from that side 4A which contacts the belt 3 toward the exposed uneven side 4B of the stream.

Another input of the dividing circuit 42 receives second signals from the detector 8 which is shiftable with the trimming device 6 in response to signals transmitted from detector 27 to motor 106 via conductor means 28. The detector 8 may constitute an inductive distance measuring device of the type sold by Collins Corporation under the designation Linear Motion SS-104, S/M 4886. The detector 8 may serve the dual purpose of indicating the position of the device 6 and of transmitting signals to the circuit 42.

The dividing circuit 42 constitutes a means for deriving from first signals (furnished by detector 7) and from second signals (furnished by detector 8) third signals whose intensity or another characteristic denotes the difference between the characteristics of the first and second signals, and the output of the circuit 42 transmits such third signals to a device which adjusts the distributor D in such a way that the rate of transport of tobacco particles 61 to the station 62 is reduced when the quantity of particles forming the surplus increases and vice versa. More specifically, each third signal is a quotient of the corresponding first and second signals. The intensity of third signals can be determined by observing the scale of an indicating instrument 43 connected to the output of the circuit 42. This output is further connected to one input of a subtracting circuit 46 in response to closing of a switch 44. Another input of the circuit 46 receives a reference signal from an adjustable potentiometer 47 or another suitable source of reference signals. The reference signal denotes the desired surplus of tobacco particles 61 in the stream 4a. The signal at the output of the circuit 42 denotes the actual surplus of particles 61 in the stream 4a. The output of the subtracting circuit 46 is connected with one input of a multiplexer 48 (e.g., a circuit of the type known as AD 530 sold by Analog Devices). The signal from 46 to 48 denotes the difference between the actual and desired surplus. Another input of the multiplexer 48 is connected with a tachometer generator 49 which monitors the speed of a variable-speed motor 51 constituting the main prime mover of the cigarette making machine. The output of the circuit 48 transmits a signal which is indicative of the surplus removed by the equalizing device 6.

The output of the multiplexer 48 transmits the signal which denotes the surplus to a signal comparing junction 52 which further receives signals from a tachometer generator 53 serving to monitor the RPM of a variable-speed electric motor 54 for the band 60 in the distributor D. The junction 52 transmits a positive or negative signal to an adjustable output amplifier 56 serving to regulate the speed of the motor 54 and hence the rate at which the band 60 delivers tobacco particles 61 to the stream building station 62. In the embodiment of FIG. 2, the junction 52 would transmit a positive signal which would cause the amplifier 56 to increase the RPM of the motor 54. The operative connection between the circuit 42 and the band 60 is indicated in FIG.

1 by a phantom line 57. This line denotes the parts shown in the lower right-hand portion of FIG. 2.

The switch 44 is opened during the initial stage of operation of the machine, i.e., immediately after starting of the motors 51 and 54 and while the channel 2 is still empty.

If desired, the signal at the output of the amplifier 39 can directly influence the motor 106. Thus, such signal can be transmitted to a signal comparing stage 70 for comparison with a reference signal from a source 71, and the output of the stage 70 can transmit correction signals to the motor 106. The reference signal which is furnished by the source 71 denotes the desired or optimum height h of the stream 4*a*. It is preferred to connect a suitable averaging circuit 72 in the conductor means 73 between the stage 70 and the motor 106 in order to prevent continuous shifting of the knife 6 toward or away from the belt 3.

The improved apparatus is susceptible of many modifications without departing from the spirit of the invention. For example, the detector 8 can be replaced with a detector similar to the optical level detector 7. Also, the circuit 42 can be replaced with a subtracting circuit.

An important advantage of the improved apparatus is that, by determining the geometric shape of the tobacco stream, and more particularly the configuration of the exposed uneven upper surface 4B of the stream, the regulation of tobacco feed to the stream building zone 62 can be effected in dependency on another parameter which is a function of the mode of operation of the equalizing device 6. This insures that the quantity of tobacco particles forming the surplus can be caused to more accurately conform to the characteristics of tobacco and that such quantity can be adjusted with a minimum of delay. Furthermore, the height of the stream 4*a* can be ascertained rapidly, accurately and without contacting successive increments of the stream at the monitoring station. If desired, the connection 70–73 between the transducer 37 and the motor 106 can be designed in such a way that it influences the removal of surplus only when the measured height is outside of a predetermined range of heights. As a rule, the path of the stream 4*a* at the monitoring station is horizontal or nearly horizontal, i.e., the side 4A of the stream 4*a* rests on the upper portion or reach of the belt 3 or adheres by suction to the underside of the lower reach of the belt. Thus, the rays 36 are normally horizontal and are directed (by mirrors 33, 34) substantially transversely of the path for the stream 4*a*.

As shown in FIG. 2, the level detector 7 can be installed at one side of the path for the stream 4*a*, with the single exception of the mirror 34 which is installed at the other side of the path. Each element 38 is mounted at a different distance from the first side 4A of the moving stream 4*a*, and each such element registers with a different light ray or group of light rays to generate a signal when its photosensitive surface receives light which is reflected by the mirrors 34, 33, 32. The parallel light rays together constitute a relatively thin but wide light beam which is preferably located in a plane extending at right angles to the direction of transport of the stream 4*a* and at right angles to the plane of that portion of the belt 3 which contacts the side 4A. The width of the light beam is sufficient to insure that the detector 7 can monitor the height of the highest hill at the uneven exposed or second side 4B of the moving stream 4*a*.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. A method of measuring the height of a stream, especially a relatively narrow stream, which consists of tobacco particles or the like, which has a first side and an uneven second side located opposite the first side, which contains a surplus of particles and from which the surplus is about to be removed prior to draping of the resulting equalized stream into a web of wrapping material and subdivision of the draped equalized stream into discrete rod-shaped articles, comprising the steps of moving the stream lengthwise along a predetermined path including contacting the first side of the stream; optically scanning the distance between said first and second sides of successive increments of the moving stream including establishing a source of light rays and directing said light rays across the moving stream at different distances from said first side of the stream so that the number of light rays which are intercepted by an increment of the stream is indicative of the height of the respective increment, said directing step including reflecting the non-intercepted rays back across the moving stream; and generating signals denoting the number of reflected rays.

2. A method as defined in claim 1, wherein the light rays which issue from said source are parallel to each other.

3. A method as defined in claim 1, further comprising the step of removing the surplus from said stream at a rate which is a function of deviations of said signals from a reference signal denoting a predetermined height of the stream.

4. In a machine for converting a stream, especially a relatively narrow stream, which consists and contains a surplus of tobacco particles or the like and has a first side and an uneven second side located opposite said first side into discrete rod-shaped articles by removing the surplus at said second side, draping the thus equalized stream into a web of wrapping material and subdividing the wrapped stream into sections of predetermined length, apparatus for measuring the height of said stream between said first and second sides prior to removal of said surplus, comprising means for conveying the stream lengthwise, said conveying means including a portion contacting the first side of the stream; and opto-electrical level detector means adjacent said conveying means and including means for monitoring the distance between said first and second sides of successive increments of the moving stream, said monitoring means comprising a source of light rays, means for directing said light rays across the moving stream on said conveying means at different distances from said portion of said conveying means so that the number of light rays which are intercepted by an increment of the stream is indicative of the respective distance, and a plurality of light-sensitive signal generating elements each registering with a different light ray so that the number of light-sensitive elements upon which light rays impinge is indicative of the height of the respective increment of the stream, said directing means comprising means for reflecting the non-intercepted light rays back across the moving stream and upon the corresponding light-sensitive elements.

5. The structure of claim 4, wherein said source comprises means for forming a plurality of parallel light rays.

* * * * *